United States Patent [19]

Klopfenstein et al.

[11] Patent Number: 4,926,893

[45] Date of Patent: May 22, 1990

[54] PORTABLE, COLLAPSIBLE ICE FISHING SHELTER

[76] Inventors: Rick Klopfenstein; Tom Kreitzer, both of 203 E. State St., Botkins, Ohio 45306

[21] Appl. No.: 365,604

[22] Filed: Jun. 13, 1989

[51] Int. Cl.[5] ..... E04H 15/44

[52] U.S. Cl. ..... 135/106; 135/111; 135/116; 135/119; 135/901

[58] Field of Search ..... 135/901, 119, 111, 106, 135/87, 116, 115

[56] References Cited

U.S. PATENT DOCUMENTS

| | | | |
|---|---|---|---|
| 3,513,605 | 5/1970 | Smith | 135/901 X |
| 3,570,507 | 3/1971 | Kashuba | 135/901 X |
| 3,739,536 | 6/1973 | Ward | 135/901 X |
| 3,826,270 | 7/1974 | Hentges | 135/901 X |
| 3,913,598 | 10/1975 | Glutting, Jr. et al. | 135/901 X |
| 4,067,346 | 1/1978 | Husted | 135/901 X |
| 4,084,597 | 4/1978 | Compton | 135/901 X |

FOREIGN PATENT DOCUMENTS

| | | | |
|---|---|---|---|
| 117199 | 7/1918 | United Kingdom | 135/111 |
| 1091842 | 11/1967 | United Kingdom | 135/106 |

*Primary Examiner*—David A. Scherbel
*Assistant Examiner*—Lan Mai
*Attorney, Agent, or Firm*—Terry M. Gernstein

[57] ABSTRACT

A portable, collapsible ice fishing shelter includes a frame assembly and a unitary covering assembly. The frame assembly includes a base, vertical and horizontal frame elements and the covering assembly is releasably attached to the frame by snap fasteners. Specially shaped runners are mounted on the base and permit the shelter to be moved across difficult terrain.

6 Claims, 2 Drawing Sheets

PORTABLE, COLLAPSIBLE ICE FISHING SHELTER

TECHNICAL FIELD OF THE INVENTION

The present invention relates to the general art of amusement devices, and to the particular field of ice fishing. Specifically, the present invention relates to the field of portable shelters for use by fishermen to protect them from the weather.

BACKGROUND OF THE INVENTION

The sport of ice fishing has become extremely popular in recent times. Since ice fishing is performed out-of-doors, and often in difficult weather conditions, the ice-fisherman generally requires some sort of shelter from the elements. Therefore, with this increase in popularity of ice fishing, there has been a concomitant increase in the demand for ice fishing shelters.

There has thus been several proposals for ice fishing shelters, see U.S. Pat. Nos. 3,173,436 and 4,438,040 for example.

While the presently available ice fishing shelters are somewhat successful, there are several shortcomings that prevent or at least inhibit the full commercial acceptance of such shelters. Principal among these shortcomings is the provision of space to comfortably seat only one occupant in the shelter. If more than one fisherman is going on the expedition, several shelters must be provided, or a single shelter that is extremely cumbersome and unwieldly to transport, set up and use must be provided. Such means of accommodating plural fisherman can also be expensive.

Furthermore. presently available ice fishing shelters, because they are designed for only one occupant, generally are suitable for use with but a single ice fishing hole. If the fisherman wishes to use several fishing holes, he must go outside the shelter, which defeats some of the purpose of the shelter.

Still further, presently available ice fishing shelters have runners that are designed as skids, and thus are not fully effective in many situations involving the difficult terrain often encountered in ice fishing.

Accordingly, there is a need for a portable, collapsible ice fishing shelter that can accommodate more than one fisherman, and more than one fishing hole, yet is easily stored, set up and transported.

OBJECTS OF THE INVENTION

The main object of the present invention is to provide a portable, collapsible ice fishing shelter that can comfortably accommodate more than one person.

It is another object of the present invention to provide a portable, collapsible ice fishing shelter that is easily collapsed and set up and easily transported.

It is another object of the present invention to provide a portable, collapsible ice fishing shelter that permits a fisherman to move from one fishing hole to another in an easy manner without leaving the shelter.

SUMMARY OF THE INVENTION

These, and other, objects are achieved by a portable, collapsible ice fishing shelter which has places for a plurality of fishing holes and a plurality of fishermen, yet is easily collapsed, stored and transported.

The shelter includes a light frame assembly and a light covering assembly which is easily attached to and detached from the frame assembly. A plurality of seats and fishing hole openings are provided whereby several fishermen can be comfortably accommodated in the shelter, or a single fisherman can move from one hole to another without leaving the shelter.

DESCRIPTION OF THE DRAWING FIGURES

Figure 4:
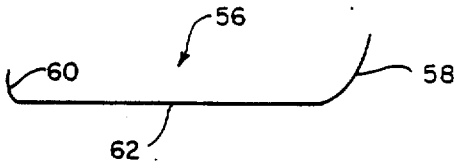

FIG. 4 side elevational view of a runner used on the ice fishing shelter of the present invention.

Figure 5:
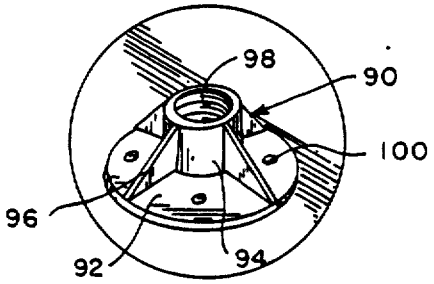
Figure 6:
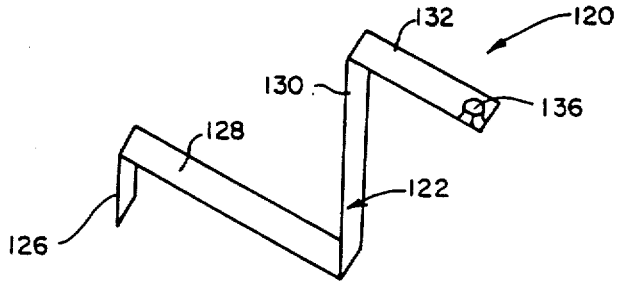

FIG. 5 is a perspective view of one of the seat brace elements used in the ice fishing shelter FIG. 6 is a perspective schematic view of a hitch element used to connect the fishing shelter to a towing vehicle.

FIG. 7A illustrates a block mounted on the frame assembly base with a support attached.

FIG. 7B illustrates a block mounted on the frame assembly without a support attached.

FIG. 8 is a side elevational view of a block mounted on the frame assembly.

DETAILED DESCRIPTION OF THE PREFERRED EMBODIMENT OF THE INVENTION

Figure 1:
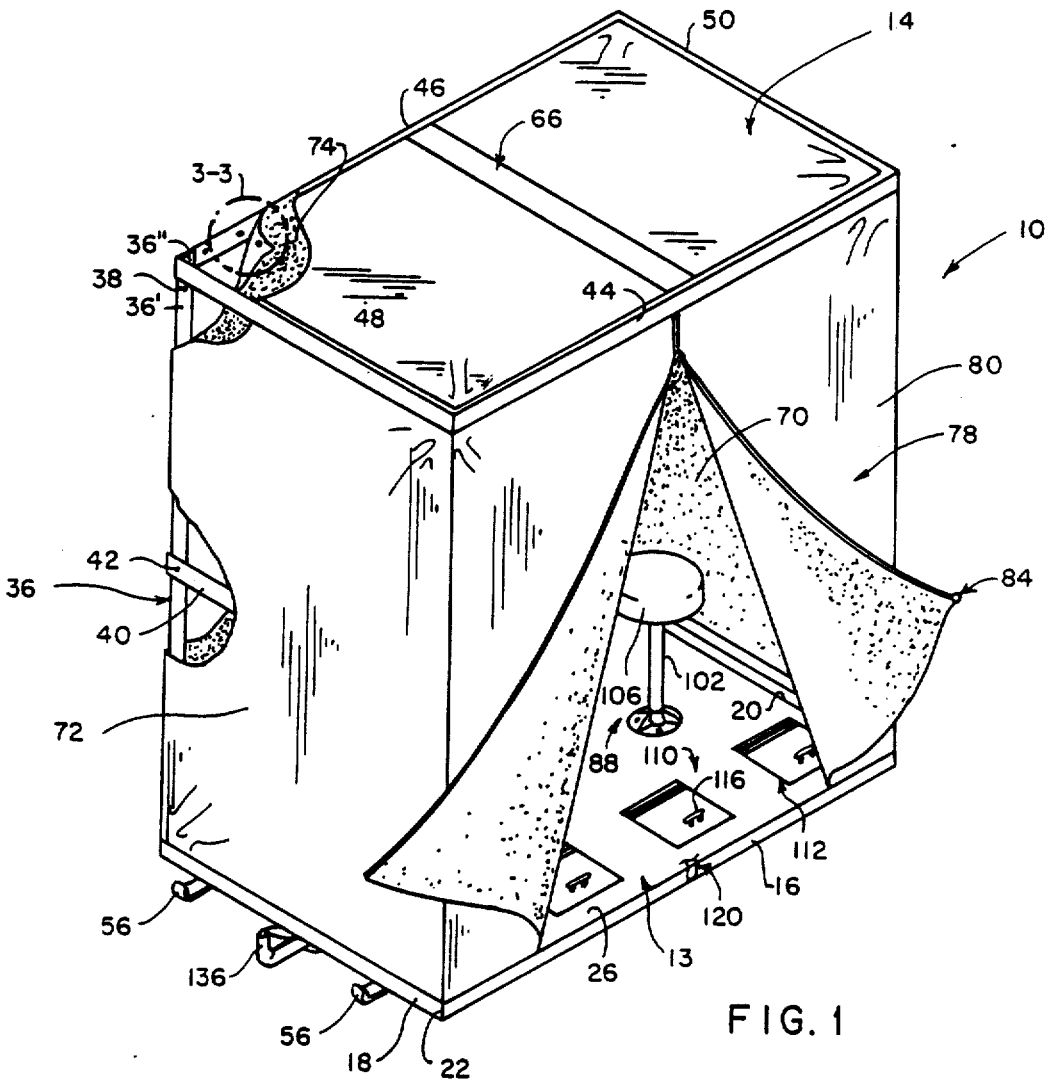
FIG. 1 is a perspective view of the portable, collapsible ice fishing shelter of the present invention in the set-up configuration.
Figure 2:
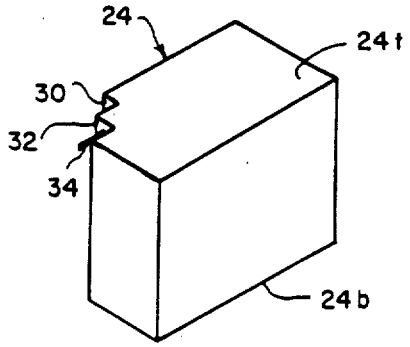
FIG. 2 is a perspective view of one of the frame assembly blocks used in the ice fishing shelter.

Shown in FIG. 1 is a portable, collapsible ice fishing shelter 10 embodying the present invention. The shelter 10 includes a frame assembly 12 and a covering assembly 14 which are separable for storage and transport, yet which are easily couplable for easy set up to comfortably accommodate several occupants, or one occupant who is running several fishing holes at once.

The frame assembly 12 includes a base 13 which is rectangular to have a front side 16, a rear side (not seen in FIG. 1), and ends 18 and 20 which intersect the sides at corners, such as corner 22.

The frame assembly further includes four support blocks, such as block 24, best shown in FIGS. 2, 7A, 7B and 8. One block is located at each corner of the base, and is firmly affixed to top surface 26 of the base by fasteners, such as bolts or the like. Each block includes a groove 30 in one surface and a groove 32 in an adjacent surface. The grooves are oriented at 90' to each other and extend for essentially the entire length of the block from bottom surface **24*b* to top surface 24*t*, and include fasteners, such as bolt 34** embedded in the block, to define a guide slot for a purpose that will be seen from the ensuring discussion.

The frame assembly further includes a plurality of vertical supports, such as support 36 each located at one corner of the base. Each vertical support includes two legs, such as leg 36' and leg 36" of support 36, which intersect each other at a right angle to form an L-shape. Each vertical support is attached to the base 13 at one of the corners of that base, and is affixed to the block located at that corner by the fasteners 34 fitting through holes, such as hole 38 in leg 36' of support 36, and having nuts or the like threaded onto the fastener 34 to lock the support to the block. The slot of the block is shaped and sized to snugly accommodate the vertical support when that support extends upwardly from the base.

The frame assembly further includes a plurality of cross supports, such as cross support 40 connected to adjacent vertical supports by fastener means, such as threaded fastener 42 mounted on the vertical support and extending through a cooperating opening in the cross support. The cross supports are oriented in a plane that is parallel to a plane containing the base 13 and are spaced vertically therefrom. Preferably, the cross supports are located approximately intermediate the length of each vertical support. The preferred form of the shelter 10 includes three cross supports, one on each end and one in the rear of the shelter. The front of the shelter, along side 16 will not have a cross support for reasons that will be apparent from the following disclosure.

The frame assembly further includes a plurality of top elements that are affixed to the top of the vertical elements. These top elements are located in a horizontal plane that is parallel and spaced from the plane containing the cross supports. The top elements are located to be coplanar with the base sides and ends to form a cube-like structure. Thus, the top elements include front and rear elements 44 and 46 which correspond to the front and rear sides of the base 13, and end elements 48 and 50 which correspond to the base ends 18 and 20, respectively. The cross supports are also co-planar with these top elements and base ends and sides.

Figure 3:
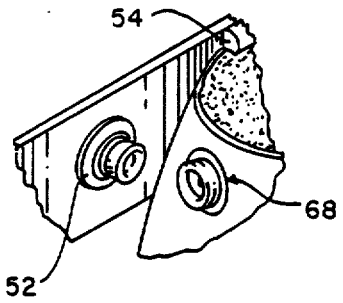
FIG. 3 is a perspective view of the snap fasteners used in the ice fishing shelter of the present invention.

A plurality of snap fastener elements, such as element 52, best shown in FIG. 3, are mounted at spaced apart locations on the top elements and the base sides. Adjacent to one of the snap fasteners is a guide element, such as guide element 54. The function of the snap fasteners and guide elements will be discussed in greater detail below.

A plurality of runners, such as runners 56, are mounted on the bottom surface of the base 13 to facilitate moving the shelter across ice and snow. The runners can be ski-like, but preferably are shaped as best shown in FIG. 4 to include an arcuate leading edge 58 and a following edge 60 which are connected together by a planar body 62. This shape will support the weight of the shelter while permitting that shelter to be moved easily over the terrain that is expected in ice fishing areas.

The covering assembly 14 is unitary and includes a plurality of sections. The preferred embodiment of the shelter includes a tarpaulin-like covering assembly that is attached to the frame assembly by the snap fasteners discussed above. The covering assembly includes a top section 66 that is sized and shaped to correspond in size and shape to the size and shape of the base 13 and which includes snap fastener elements, such as snap fastener element 68, best shown in FIG. 3, on the perimeter thereof to releasably attach the top section to the frame top elements.

The covering assembly further includes a pair of end sections 70 and 72 and a rear section 74 that are located respectively to be adjacent to the base ends and base rear side. The covering assembly end and rear sections are divided from the top section by the fasteners 68 and have fasteners, such as fastener 68, on the bottom edges thereof to releasably couple those sections to the base via the fasteners on the ends and sides of the base.

The covering assembly is thus quite easily erected after the frame is erected by simply snapping the covering assembly fastener elements to the frame assembly fastener elements.

The covering assembly further includes a front section 78 that has two panels 80 and 82 affixable to the frame top element 44 and to the base side edge 16 by snap fastener elements in the manner discussed above. The panels 80 and 82 are releasably connected by a zipper element 84 to be openable and closable in the manner of a door to permit ingress and egress to and from the interior of the shelter.

Erection and knock-down of the shelter is quite easily effected by simply attaching the vertical supports 36 to the blocks 24, and the cross support elements 40 to the vertical supports. The top elements 44–50 are then attached to the vertical supports, and the covering assembly is attached via the snap fasteners. Knock down of the shelter is the opposite process.

In order to comfortably accommodate a plurality of fisherman, the shelter 10 includes a plurality of spaced-apart seat assemblies, such as seat assembly 88 therein. Each seat assembly includes a base-mounted brace element 90, best shown in FIG. 4. The brace element 90 includes a footing element 92 and a guide element 94, with buttress elements, such as element 96, supporting the guide element. The guide element is tubular and is internally threaded to include threads 98. Fasteners, such as screws 100, attach the footing element to the frame base 13 as shown in FIG. 1.

Each seat assembly further includes a support post, such as post 102, mounted in the guide element 94. To this end, each support post includes external threads on one end thereof to cooperate with the internal threads 98 of the footing guide. The support posts are mounted to extend vertically upward from the frame assembly base upper surface, and include a seat element 106 thereon. Due to the threaded nature of the connection of the support posts to the guide elements, the erection and collapsing of these elements of the shelter is quick and easy. The footing elements can be permanently affixed to the base 13 without interfering with the overall ease of set up and knock down of the overall shelter.

The shelter 10 also includes a fishing assembly 110 that include a plurality of spaced-apart openings through the base 13 and which are each covered by a cover 112. Each cover is hingeably attached to the base 13 and includes a handle, such as handle 116 for opening and closing that cover to open and close the fishing opening in the base.

Each of the openings is located near one of the seat assemblies so that a fisherman seated thereon has easy access to the fishing opening.

The frame assembly further includes a hitch means 120, best shown in FIG. 6, and schematically illustrated in FIG. 1 for reference. The hitch means includes a double-L shaped body 122 having a first section 126 that is affixed to the base front side 16, and a second section 128 that extends horizontally outward and forward of the base 13 when the section 126 is affixed thereto. A third section 130 extends vertically upwardly from the second section, and a fourth section 132 extends horizontally outward and forward of the third section. The fourth section includes a trailer hitch ball unit 136 thereon, and such ball unit is adapted to connect to a trailer hitch socket assembly on a towing vehicle as is well known in the trailer towing art. The details of the trailer hitch ball and socket elements will not be discussed as those skilled in the art will understand what is included based on the disclosure herein.

It is understood that while certain forms of the present invention have been illustrated and described herein, it is not to be limited to the specific forms or arrangements of parts described and shown.

I claim:

1. A portable, collapsible ice fishing shelter comprising:

(A) a frame assembly which includes
  (1) a rectangular base which includes sides and ends which intersect said sides to form corners,
  (2) a support block located at each of said corners and each including
  (a) orthogonally arranged side faces,
  (b) a groove defined in two adjacent side faces, with said grooves intersecting to form an L-shaped guide that extends for essentially the entire length of said block and to extend vertically upward from said frame assembly base when said block is affixed to said base,
  (3) a plurality of vertical L-shaped supports each attached at one end to one of said blocks adjacent to said guide and extending vertically upward from said base,
  (4) a plurality of cross supports, each connecting adjacent vertical supports together at a location that is vertically spaced from said base,
  (5) a plurality of horizontal top elements, each attached to another end of said vertical supports and extending horizontally at a location vertically spaced from said base,
  (6) frame assembly snap fastener elements on said base and on said top elements, and
  (7) a plurality of ski-like runners mounted on said base to be parallel to said base sides and to each other;

(B) a unitary covering assembly including
  (1) a top section,
  (2) a rear section,
  (3) side sections, and
  (4) a front section which has two panels and a zipper for securing said panels together, and
  (5) snap fastener elements which cooperate with said frame assembly snap fastener elements and secure said unitary covering assembly to said frame assembly;

(C) a seat assembly which includes
  (1) a plurality of spaced apart seat brace elements mounted on said frame assembly base,
  (2) a seat member releasably coupled to each seat brace and including
  (a) a support post releasably coupled to said seat brace, and
  (b) a seat element attached to said post; and (D) a fishing opening assembly which includes
  (1) a plurality of spaced apart openings defined through said frame assembly base,
  (2) a cover hingeably connected to said frame assembly base adjacent to each opening and each including a handle.

2. The shelter defined in claim 1 further including a hitch means on said base for connecting said frame assembly to a towing vehicle.

3. The shelter defined in claim 2 wherein each of said runners includes an arcuate front section, a rear section and a planar central section connecting said front and rear sections together.

4. The shelter defined in claim 3 further including fasteners in said blocks.

5. The shelter defined in claim 4 further including fasteners on said cross supports.

6. The shelter defined in claim 5 further including fastener receiving elements on said vertical supports.

* * * * *